US012317945B2

(12) United States Patent
Yao

(10) Patent No.: US 12,317,945 B2
(45) Date of Patent: Jun. 3, 2025

(54) ATHLETIC GARMENT WITH A POCKET FOR A CHAMOIS

(71) Applicant: Adventurish LLC, Los Angeles, CA (US)

(72) Inventor: Marites J. Yao, Los Angeles, CA (US)

(73) Assignee: Adventurish LLC, Los Angeles, CA (US)

( * ) Notice: Subject to any disclaimer, the term of this patent is extended or adjusted under 35 U.S.C. 154(b) by 58 days.

(21) Appl. No.: 18/050,524

(22) Filed: Oct. 28, 2022

(65) Prior Publication Data

US 2023/0180870 A1 Jun. 15, 2023

Related U.S. Application Data

(60) Provisional application No. 63/263,273, filed on Oct. 29, 2021.

(51) Int. Cl.
*A41D 27/20* (2006.01)
*A41D 1/06* (2006.01)

(52) U.S. Cl.
CPC ..... *A41D 27/201* (2013.01); *A41D 1/06* (2013.01); *A41D 2600/104* (2013.01)

(58) Field of Classification Search
CPC ..... A41D 2600/104; A41D 13/0012; A41D 1/084
See application file for complete search history.

(56) References Cited

U.S. PATENT DOCUMENTS 1,912,327 A * 5/1933 Vaccaro ..... A41D 1/06 2/228
1,970,110 A * 8/1934 Vaccaro ..... A41D 27/20 2/247
3,484,868 A * 12/1969 Davenport, Jr. ..... A63B 71/12 2/467
3,894,542 A * 7/1975 Sacristan ..... A41C 1/003 450/123
3,909,847 A * 10/1975 Holt ..... A41D 1/088 2/466
4,805,243 A * 2/1989 Gibbens ..... A41D 1/084 2/253
4,945,571 A * 8/1990 Calvert ..... A41D 13/0581 2/164
5,103,505 A * 4/1992 Llorens ..... A41D 13/0537 2/403
5,365,610 A * 11/1994 Lubahn ..... A41D 13/0593 2/23
5,539,926 A * 7/1996 Mantos ..... A41D 1/08 2/234
5,636,377 A * 6/1997 Wiener ..... A41D 13/1254 2/2.5

(Continued)

FOREIGN PATENT DOCUMENTS

ES 2623095 T3 * 7/2017 ..... A61F 13/15577
FR 3097104 A1 * 12/2020 ..... A41B 9/12

(Continued)

*Primary Examiner* — Khaled Annis
(74) *Attorney, Agent, or Firm* — Dechert LLP

(57) ABSTRACT

The description provides a pair of cycling leggings or shorts comprising a pocket for a removable chamois. Said pocket for chamois has a narrow opening on the front end and a wide opening on the back end, so that a removable chamois can be slipped in and removed as needed.

19 Claims, 3 Drawing Sheets

(56) References Cited

U.S. PATENT DOCUMENTS 5,649,328 A * 7/1997 Martin ..... A41D 13/0537 2/238
5,749,101 A * 5/1998 Breindel ..... A41D 13/0575 2/403
5,790,984 A * 8/1998 Doubleday ..... A41D 13/02 2/408
5,978,970 A * 11/1999 Bright ..... B62J 1/007 2/467
6,182,297 B1 * 2/2001 Duren ..... A41D 13/0575 450/99
6,532,599 B1 * 3/2003 Dugan ..... A41D 1/089 2/227
6,961,958 B1 * 11/2005 Seitzinger ..... F41H 1/02 2/2.5
8,272,073 B2 * 9/2012 Arensdorf ..... A41D 13/0158 2/228
9,125,441 B2 * 9/2015 Maier ..... A41D 1/084
9,642,402 B1 * 5/2017 Scherr ..... A41D 13/0593
9,867,404 B1 * 1/2018 Holtzman ..... A41D 1/084
10,076,141 B2 * 9/2018 Nhim ..... A41D 1/08
10,092,042 B2 * 10/2018 Samuel ..... A41B 9/12
10,226,638 B2 * 3/2019 Oskin ..... A61N 1/04
10,555,572 B2 * 2/2020 Diakonov ..... A41F 9/00
11,246,361 B1 * 2/2022 Wimer-Golebiowski ..... A41D 1/22
2006/0191052 A1 * 8/2006 Bulian ..... A41D 1/084 2/23
2007/0186328 A1 * 8/2007 Bulian ..... A41D 1/084 2/69
2007/0294803 A1 * 12/2007 Furgerson ..... A41D 1/084 2/227
2009/0113598 A1 * 5/2009 Maier ..... A41D 1/084 2/227
2009/0300818 A1 * 12/2009 Waite ..... A63B 47/001 2/76
2010/0071111 A1 * 3/2010 Riondato ..... A41D 1/084 2/79
2010/0095432 A1 * 4/2010 Liou ..... A41D 1/084 2/227
2010/0095442 A1 * 4/2010 Kuipers ..... A41D 1/084 2/466
2012/0005813 A1 * 1/2012 Lambertz ..... A41D 1/084 2/466
2012/0030864 A1 * 2/2012 Marois ..... A41D 27/20 2/247
2012/0073028 A1 * 3/2012 Knopik ..... A41D 31/18 2/79
2012/0222191 A1 * 9/2012 Maier ..... A41D 1/088 2/227
2012/0233752 A1 * 9/2012 Kemma ..... A41D 1/084 2/69
2012/0266361 A1 * 10/2012 Maier ..... A41D 1/084 2/227
2013/0047312 A1 * 2/2013 Wilson ..... A41D 13/0012 2/69
2014/0359925 A1 * 12/2014 Maier ..... A41D 13/0525 2/466
2014/0359926 A1 * 12/2014 Maier ..... A41D 13/0525 2/466
2015/0074885 A1 * 3/2015 De Soto, II ..... A41D 1/084 2/466
2015/0151184 A1 * 6/2015 Maier ..... A63B 71/1216 2/466
2015/0313292 A1 * 11/2015 Knopik ..... A41D 1/084 2/228
2016/0295931 A1 * 10/2016 Tsuei ..... A41D 1/084
2020/0329796 A1 * 10/2020 Maier ..... A41D 31/28
2020/0337387 A1 * 10/2020 Weirtz ..... A41C 1/003
2022/0015482 A1 * 1/2022 Vysotska ..... A41D 27/205
2022/0095706 A1 * 3/2022 Williams ..... A41D 1/088
2023/0180870 A1 * 6/2023 Yao ..... A41D 13/0012 2/247
2023/0218017 A1 * 7/2023 Harrison ..... A41D 1/21 2/228

FOREIGN PATENT DOCUMENTS

GB 2588583 A * 5/2021 ..... A41D 1/084
JP 2012224957 A * 11/2012
WO WO-2021074640 A1 * 4/2021 ..... A41D 1/084

* cited by examiner

ATHLETIC GARMENT WITH A POCKET FOR A CHAMOIS

CROSS-REFERENCE TO RELATED APPLICATIONS

The present application claims priority under 35 U.S.C. § 119(e) from U.S. Provisional Application No. 63/263,273, filed Oct. 29, 2021, which is incorporated herein by reference in its entirety.

FIELD OF THE INVENTION

The present disclosure relates to athletic garments and, in particular, a pair of cycling leggings or shorts having a pocket for a removable chamois.

BACKGROUND OF THE INVENTION

Many bicycle riders wear tight fitting clothing which can stretch and flex. The clothing may be a one-piece bib liner style athletic garment or the clothing may comprise separate garments, a jersey and a short or legging for example. The tight-fitting garment may also include a chamois for seat comfort. Traditional cycling leggings and shorts typically contain a chamois that is permanently sewn into the garment. However, it can be inconvenient to travel by bicycle and then have to continue to wear a garment with a chamois and/or find somewhere to change clothes. The present disclosure provides a solution for this problem.

SUMMARY OF THE INVENTION

The systems, methods and devices described herein have innovative aspects, no single one of which is indispensable or solely responsible for their desirable attributes. Without limiting the scope of the claims, some of the advantageous features are summarized herein.

One aspect of the present invention is the realization that some bikers may prefer to wear cycling leggings and shorts which allow for a removable chamois. In addition, some bikers may prefer to wear cycling leggings and shorts without a chamois for leisure, whereas traditional cycling leggings and shorts contain a chamois due the seams outlining the shape of the chamois. Thus, there exists need for an improved athletic garment, which has a pocket allowing a chamois to be slipped in and removed when needed, and which does not have the outside seams to make it more aesthetically pleasing for leisure.

One non-limiting embodiment of the present invention includes a pair of cycling leggings or shorts comprising three layers: Layer 1 (outer shell), Layer 2 (lining sewn into Layer 1 from inside), and Layer 3 (a pocket for chamois sewn to lining from inside). Said pocket for chamois has a narrow opening on the front end and a wide opening on the back end close to the waistline. A removable chamois can be slipped into the pocket from the wide opening toward the narrow opening, and the narrow opening provides an access to pull the chamois inside to a secure fit. The removal chamois can be pulled out from the wide opening when needed.

In some embodiments, the pair of cycling leggings or shorts further comprise one or more pockets at each side of the leggings or shorts for storing items therein, such as food, water, and tools.

Another non-limiting embodiment of the present invention includes a method of manufacturing the invention described herein.

Another non-limiting embodiment of the present invention includes a method of use of the invention described herein.

BRIEF DESCRIPTION OF THE DRAWINGS

Throughout the drawings, reference numbers can be reused to indicate general correspondence between reference elements. The drawings are provided to illustrate example embodiments described herein and are not intended to limit the scope of the disclosure.

DETAILED DESCRIPTION OF THE PREFERRED EMBODIMENTS

Figure 1B:
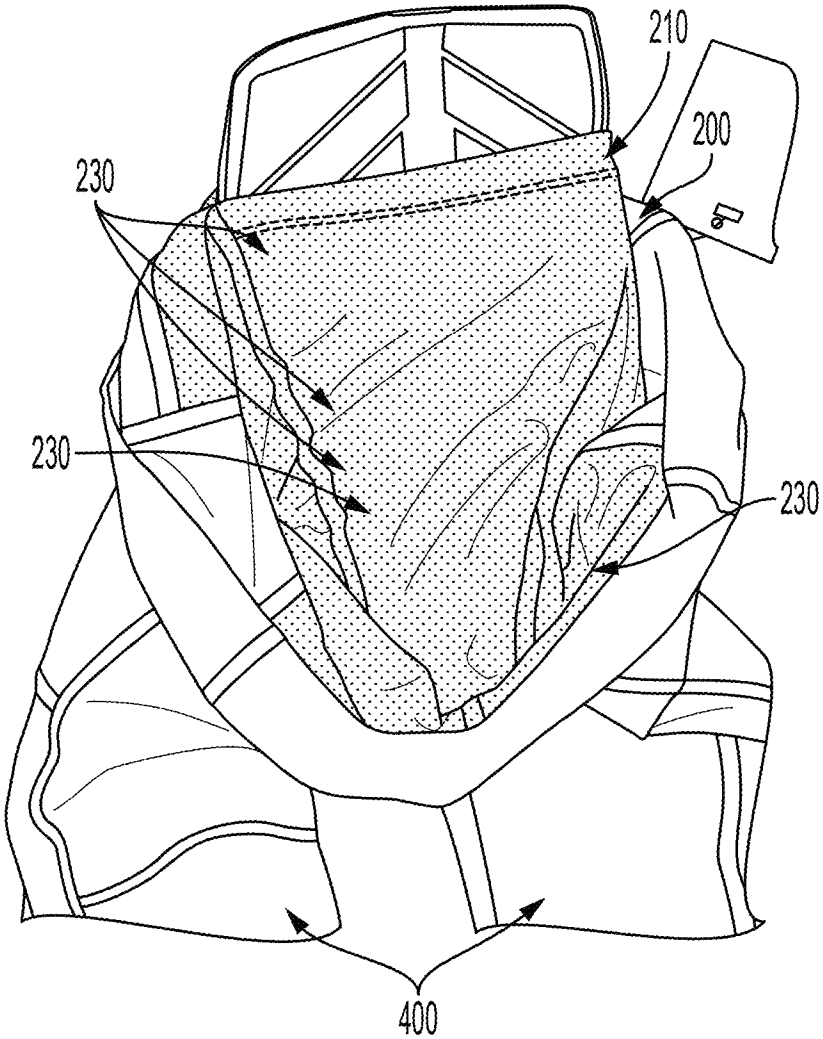
FIG. 1B illustrates a view of the rear portion of one embodiment of an athletic garment, which is turned inside out, showing a pocket for chamois with a wide opening close to the waistline, from where a chamois can be slipped in and out of the pocket.

The description provides for a garment that covers the lower body of a human subject wherein the garment has a first and second opening for legs of the human subject, wherein a pocket is positioned between the first and second opening for the legs. In some embodiments, the pocket is positioned in the garment so that when it is worn, the pocket will be positioned between the legs of the wearer. In some embodiments, the pocket is positioned in the garment so that when it is worn it covers the sit bones (ischial tuberosities) of the wearer.

In some embodiments, the garment is selected from shorts, pants and tights. In some embodiments, the shorts comprise pant legs that cover the legs of the wearer above the knee. In some embodiments, the shorts comprise pant legs that cover the legs of the wearer to mid-calf. In some embodiments, the shorts comprise pant legs that cover the legs of the wearer to mid-thigh. In some embodiments, the pants or tights cover the entire leg of the wearer. In some embodiments, the garment is an athletic garment. In some embodiments, the athletic garment is selected from bike shorts, bike pants, triathlon shorts, a triathlon suit, bib shorts, bib tights, and hiking shorts.

The pocket comprises a back end, a front end, a left side, a right side, a proximal layer and a distal layer. The back end of the pocket is oriented toward the back of the wearer when the garment is worn. The front end of the pocket is oriented toward the front of the wearer when the garment is worn. The right side of the pocket is oriented toward the right of the wearer when the garment is worn. The left side of the pocket is oriented toward the left of the wearer when the garment is worn. The distal layer of the pocket is more distant from the wearer than the proximal layer when the garment is worn.

In some embodiments, the back end comprises a first pocket opening. In some embodiments, the front end comprises a second pocket opening. In some embodiments, the first pocket opening is larger than the second pocket opening. In some embodiments, there is a first pocket opening in the back end but no second pocket opening in the front end. In some embodiments, the diameter of the first pocket opening is about twice as long as the diameter of the second pocket opening. In some embodiments, the diameter of the first pocket opening is about 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, or 3.0 times as long as the diameter of the second pocket opening. In some embodiments, the diameter is measured when the opening to the pocket is not under tension and/or is not being stretched. In some embodiments, the diameter of the first pocket opening is about 1-6 inches, when not under tension and/or not being stretched. In some embodiments, the diameter of the first pocket opening is about 3 inches, when not under tension and/or not being stretched. In some embodiments, the diameter of the second pocket opening is about 0.5-3 inches, when not under tension and/or not being stretched. In some embodiments, the diameter of the second pocket opening is about 1 inch, when not under tension and/or not being stretched.

In some embodiments, the garment has one layer that is exposed to the outside of the garment on its distal surface and touches the skin of the wearer on its proximal surface, except where the pocket interferes with this contact. In some embodiments, the distal layer of the pocket is the single layer of the garment.

In some embodiments, the garment comprises multiple layers. In some embodiments, the distal layer of the pocket is the innermost layer of the garment except where the proximal surface of the pocket is the innermost layer of the garment. In some embodiments, where the pocket is positioned in the garment, the proximal surface of the pocket touches the skin of the wearer. In some embodiments, the proximal surface of the pocket does not touch the skin of the wearer and is not part of the innermost layer of the garment.

In some embodiments, the distal layer of the pocket is attached to the proximal layer of the pocket at its perimeter. In some embodiments, the attachment between the distal and proximal layers is made by stitching fabric. In other embodiments, the attachment between the distal and proximal layers is made by fusing the proximal and distal layers. In some embodiments, the attachment between the proximal and distal layers is made by joining the perimeters of the left and right sides. In some embodiments, the attachment between the proximal and distal layers is made by joining the left side, the right side and the front end.

In some embodiments, the pocket has a wider profile toward its back end and a narrower profile toward its front end. In some embodiments, the average distance between the left and right sides of the pocket in the back half of the pocket is about 5, 10, 20, 30, 40, 50, 60 or 70% further than the average distance between the left and right sides of the pocket in the front half of the pocket. In some embodiments, the average distance between the left and right sides of the pocket in the back half of the pocket is about 30% further than the average distance between the left and right sides of the pocket in the front half of the pocket. In some embodiments, the average distance between the left and right sides of the pocket in the back half of the pocket is about 1.0, 1.5, 2.0, 2.5, 3.0, 3.5, 4.0, 4.5, 5.0, 5.5, 6.0, 6.5 or 7.0 inches when the pocket is not under tension and/or not being stretched. In some embodiments, the average distance between the left and right sides of the pocket in the back half of the pocket is about 4 inches when the pocket is not under tension and not being stretched. In some embodiments, the average distance between the left and right sides of the pocket in the back half of the pocket is about 30% further than the average distance between the left and right sides of the pocket in the front half of the pocket. In some embodiments, the average distance between the left and right sides of the pocket in the front half of the pocket is about 0.5, 1.0, 1.5, 2.0, 2.5, 3.0, 3.5 or 4.0 inches when the pocket is not under tension and/or not being stretched. In some embodiments, the average distance between the left and right sides of the pocket in the back half of the pocket is about 2 inches when the pocket is not under tension and/or not being stretched.

In some embodiments, the maximum distance between the left and right sides of the pocket in the back half of the pocket is about 5, 10, 20, 30, 40, 50, 60 or 70% further than the maximum distance between the left and right sides of the pocket in the front half of the pocket. In some embodiments, the maximum distance between the left and right sides of the pocket in the back half of the pocket is about 30% further than the maximum distance between the left and right sides of the pocket in the front half of the pocket. In some embodiments, the maximum distance between the left and right sides of the pocket in the back half of the pocket is about 1.0, 1.5, 2.0, 2.5, 3.0, 3.5, 4.0, 4.5, 5.0, 5.5, 6.0, 6.5 or 7.0 inches when the pocket is not under tension and/or not being stretched. In some embodiments, the maximum distance between the left and right sides of the pocket in the back half of the pocket is about 4 inches when the pocket is not under tension and/or not being stretched. In some embodiments, the maximum distance between the left and right sides of the pocket in the back half of the pocket is about 30% further than the maximum distance between the left and right sides of the pocket in the front half of the pocket. In some embodiments, the maximum distance between the left and right sides of the pocket in the front half of the pocket is about 0.5, 1.0, 1.5, 2.0, 2.5, 3.0, 3.5 or 4.0 inches when the pocket is not under tension and/or not being stretched. In some embodiments, the maximum distance between the left and right sides of the pocket in the back half of the pocket is about 2 inches when the pocket is not under tension and/or not being stretched.

In some embodiments, the pocket is arranged to provide a space to contain a padding element for the wearer. In some embodiments, the padding element is a chamois. In some embodiments, the chamois has the same or a similar shape as that defined by the profile of the pocket. A chamois provides support for the pelvic girdle of a male or a female cyclist. The pelvic girdle (also known as the bony pelvis) is a basin-shaped complex of bones that connect the trunk and legs, that supports and balances the trunk, and that contains and supports the intestines, the urinary bladder, and the internal sex organs. The pelvic girdle includes paired hipbones that are connected in the front by the pubic symphysis and at the back by the sacrum, and includes the ischium on which weight falls in sitting wherein the ischial tuberosity is called the sitting bone. In some embodiments, a chamois is a male-use chamois. In some embodiments, a chamois is a female-use chamois. In some embodiments, a chamois is made of cushioning foam of varying densities, with a top surface that helps to wick moisture and provide a soft feel against the skin. Examples of chamois are provided in U.S. Pat. No. 6,687,917, incorporated by reference in its entirety.

In some embodiments, the pocket is constructed from a stretchable fabric. In some embodiments, this stretchable fabric is a knit fabric, spandex, or a spandex blend. Knit fabrics include cotton jersey, woolen jersey, 3×3 rib knit, bamboo jersey, double knit rayon blend, interlock twist jersey, double knit, silk mesh knits, and silk jersey. In some embodiments, spandex has an elastane content of about 1-15%. In some embodiments, the spandex has an elastane content of about 12-15%. In some embodiments, spandex blends include cotton spandex blend, polyester spandex blend, stretch satin, stretch velvet, nylon spandex blend, rayon knit spandex blend, acetate spandex blend, modal spandex blend, cellulose fiber spandex blend, linen spandex blend, stretch denim, stretch lace and powernet.

In some embodiments, the pocket defines a volume less than the volume of the padding element when the pocket is unstretched and defines a volume greater than the padding element when stretched. In some embodiments, when the padding element is placed in the pocket, the pocket retains tension from the presence of the padding element holding the pocket in a stretched position. In some embodiments, the tension provided by the pocket allows for the padding element to be inserted or removed by the wearer while the garment is still worn by the wearer. In some elements, the padding element can be inserted or removed from the pocket through the first opening. In some embodiments, the garment must be removed to insert the padding element into the pocket through the first opening. In some embodiments, the garment must be removed to remove the padding element from the pocket through the first opening.

In some embodiments, the pocket further comprises additional fasteners that reduce the size of the first opening or that close the first opening completely. In some embodiments, the fastener is a reusable fastener, such as, for example, snaps, buttons, zippers, hook and loop fasteners such as those sold in connection with the trademark VELCRO®, magnets, etc. In other embodiments, the pocket contains no fasteners. In some of these embodiments, the tension from stretching the pocket with the padding element is sufficient to hold the padding element in place while the garment is worn.

In certain embodiments, the chamois is about 3-20 mm thick. In some embodiments, the chamois is about 5-15 mm thick. In some embodiments, the chamois is about 8-12 mm thick. In some embodiments, the chamois is about 3, 4, 5, 6, 7, 8, 9, 10, 11, 12, 13, 14, 15, 16, 17, 18, 19 or 20 mm thick.

In some embodiments, an athletic garment 100 comprises three layers: Layer 1 is an outer shell, which can be a pair of leggings or shorts 400; Layer 2 is a pair of shorts 300 sewn into Layer 1 from the inside; and Layer 3 is a pocket 200 for a chamois sewn into Layer 2 from the inside.

As illustrated in FIGS. 1A-1B, 2A-2B, and 3B, the pocket 200 for a chamois is sewn into Layer 2 from the inside, wherein Layer 2 is a pair of shorts 300. The pocket 200 has two openings: a wide opening 210 on the back end close to the waistline, and a narrow opening 220 on the front end. A removable chamois can be slipped in the pocket 200 from the wide end 210, and pulled out of the pocket 200 from the wide end 210. In some embodiments, to facilitate slipping a chamois into the pocket 200, a narrow opening 220 provides access to pull the chamois inside the pocket 200. In some embodiments, the pocket 200 has stitching 230 around the outline of a chamois to hold the chamois into place. In some embodiments, the wide opening 210 comprises a fastener to secure the opening. In some embodiments, the narrow opening 220 comprises a fastener to secure the opening. In some embodiments, the fastener is a reusable fastener, such as, for example, snaps, buttons, zippers, book and loop fasteners such as those sold in connection with the trademark VELCRO®, magnets, etc.

In some embodiments the athletic garment comprises a pair of shorts 300 with a front portion 310 and a rear portion 320. When worn by a user, the front portion 310 is adjacent the abdomen while the rear portion 320 is adjacent the back. The pocket 200 for chamois is sewn into the pair of shorts 300 from the inside, with the wide opening 210 on rear portion 320 close to the waistline. In some embodiments, the narrow opening 220 is on the bottom of the rear portion 320. In some embodiments, the narrow opening 220 is on the bottom of the front portion 310.

The pair of leggings or shorts 400 has a front portion 410 and a rear portion 420. When worn by a user, the front portion 410 is adjacent the front of the legs while the rear portion 420 is adjacent the back of the legs. The pair of shorts 300 is sewn into the pair of leggings or shorts 400 from inside.

Figure 1A:
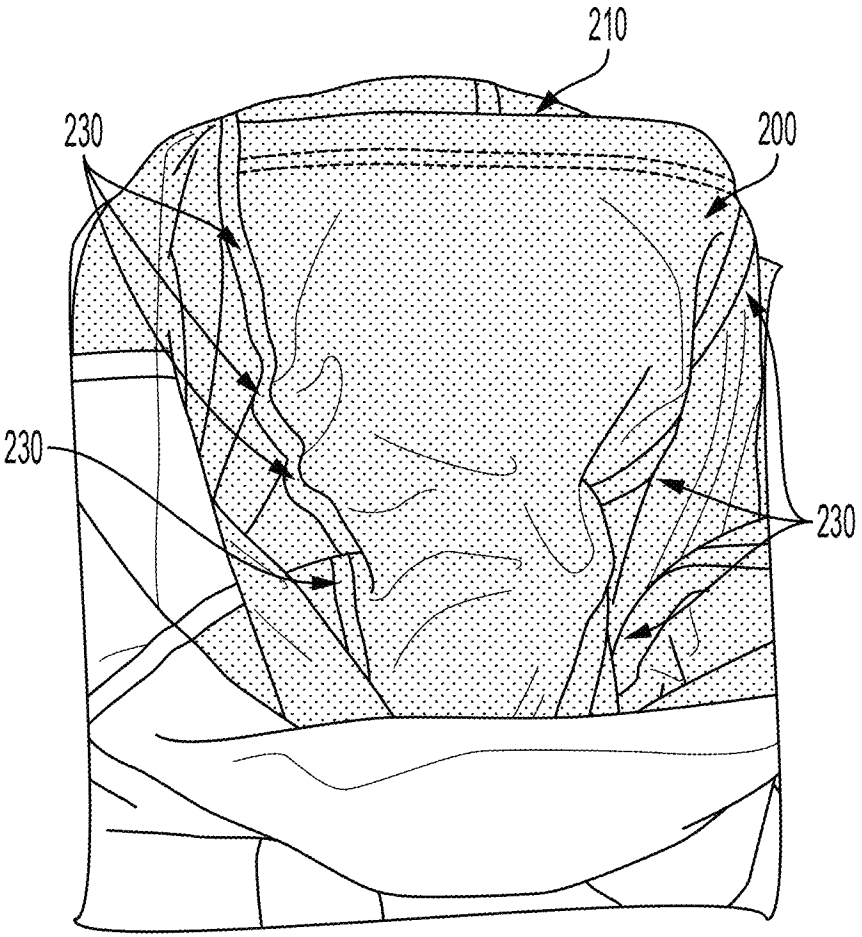
FIG. 1A illustrates a view of the rear portion of one embodiment of an athletic garment, which is turned inside out, showing a pocket for chamois with a wide opening close to the waistline, wherein the pocket does not contain a chamois.

FIG. 1A illustrates a view of the rear portion of one embodiment of an athletic garment 100, which is turned inside out, with a pocket 200 for chamois, wherein the pocket does not contain a chamois, and wherein the pocket is sewn into Layer 2, which is a pair of shorts 300, which is sewn into the outer shell, which is a pair of leggings or shorts 400. FIG. 1B illustrates a view of the rear portion of one embodiment of an athletic garment 100 of FIG. 1A, with a chamois which can be slipped in and out of the pocket. Also illustrated in FIGS. 1A and 1B are the wide opening (of the chamois pocket) 210, and the stitching 230 around the outline of a chamois to hold the chamois into place.

Figure 2B:
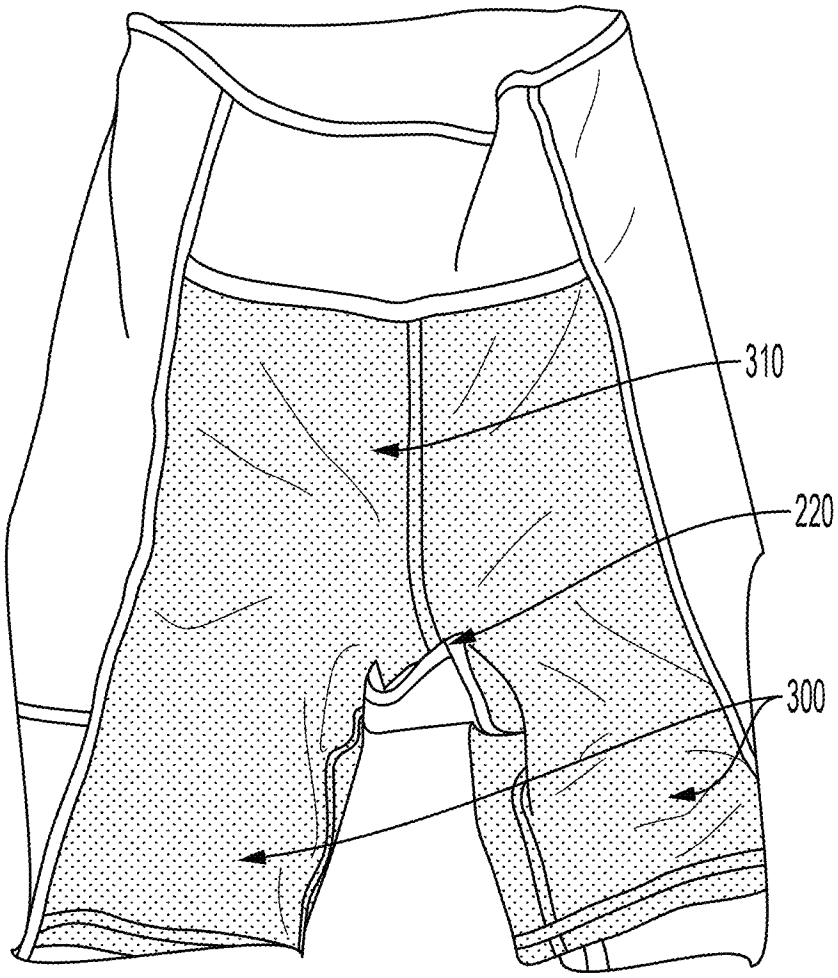
FIG. 2B illustrates a view of the front portion of one embodiment of an athletic garment, which is turned inside out, showing the narrow opening on the front end of the pocket for chamois, wherein the pocket contains a chamois.
Figure 2A:
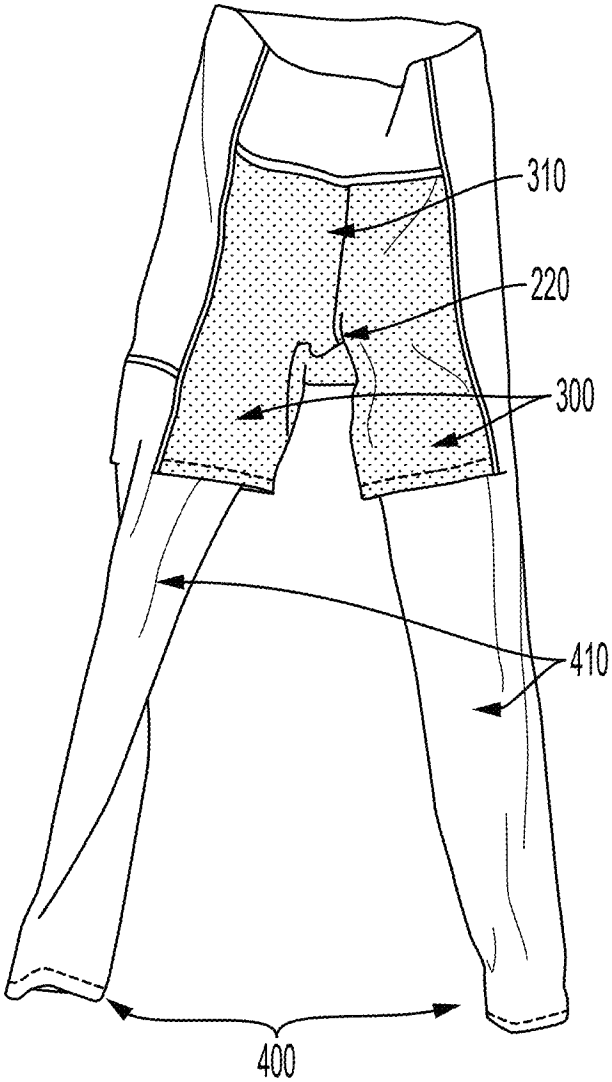
FIG. 2A illustrates a view of the front portion of one embodiment of an athletic garment, which is turned inside out, showing the narrow opening on the front end of the pocket for chamois, wherein the pocket does not contain a chamois.

FIG. 2A illustrates a view of the front portion of one embodiment of an athletic garment 100, which is turned inside out, with a pocket 200 for chamois, wherein the pocket does not contain a chamois, and wherein the pocket is sewn into Layer 2, which is a pair of shorts 300, which is sewn into the outer shell, which is a pair of leggings or shorts 400. FIG. 2B illustrates a view of the front portion of one embodiment of an athletic garment 100 of FIG. 2A, wherein the pocket contains a chamois. Also illustrated in FIGS. 2A and 2B are the narrow opening (of the chamois pocket) 220.

In one embodiment, the athletic garment 100 comprises a stretchable fabric and is constructed to snugly fit the torso of a user. In one embodiment the stretchable fabric may be vented or comprise apertures to keep the user cool. In one embodiment, the athletic garment 100 comprises a fabric which is not stretchable. In one embodiment, the athletic garment 100 comprises designs, logos, or numbers printed on the garment 100. In one embodiment, the garment 100 is for use by a casual exerciser. In one embodiment, the garment 100 is for use by an athlete. In one embodiment, the garment 100 is for use by a bicyclist, such as a road bicyclist or a mountain biker.

Figures 3A, 3B:
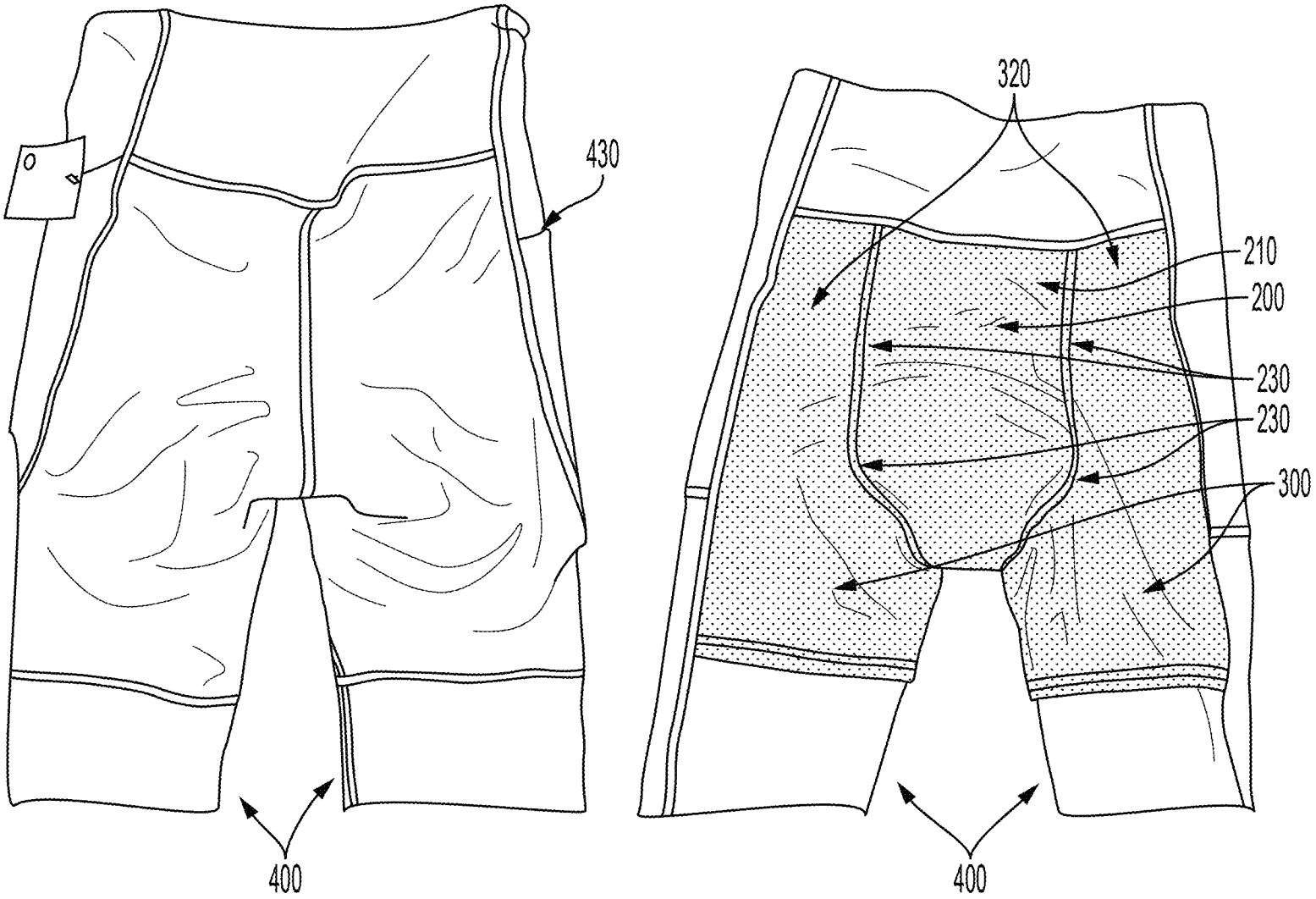
FIG. 3A illustrates a rear view of one embodiment of an athletic garment, having a seamless look with a chamois inserted.
FIG. 3B illustrates a view of the rear portion of one embodiment of an athletic garment, which is turned inside out, showing a pocket containing a chamois.

As illustrated in FIG. 3A, the pair of leggings or shorts 400 can have one or more pocket 430 at each side for storing items therein, such as food, water, and tools. The location of the pocket 430 allows the user to reach items stored in the pocket 430 without removing the athletic garment 100 by reaching around to their lower back. In one embodiment, the pocket 430 comprises a stretchable fabric forming a stretchable pocket 430 for containing objects therein with a stretch fit. In one embodiment, the pocket 430 may comprise a fabric which is not stretchable. In one embodiment, the pocket 430 may contain object therein without a stretch fit. In one embodiment, the athletic garment 100 may include additional pockets in other locations to hold additional items.

FIG. 3B illustrates a view of the rear portion of one embodiment of an athletic garment 100, which is turned inside out, showing a pocket 200 containing a chamois, wherein the pocket is sewn into Layer 2, which is a pair of shorts 300, which is sewn into the outer shell, which is a pair of leggings or shorts 400. Also illustrated in FIG. 3B are the wide opening (of the chamois pocket) 210, and the stitching 230 around the outline of a chamois to hold the chamois into place.

As used herein, the terms "about" or "approximately" have the meaning of within 20% of a given value or range. In some embodiments, the term "about" refers to within 20%, 19%, 18%, 17%, 16%, 15%, 14%, 13%, 12%, 11%, 10%, 9%, 8%, 7%, 6%, 5%, 4%, 3%, 2%, or 1% of a given value.

It should be noted that various changes and modifications to the presently preferred embodiments described herein will be apparent to those skilled in the art. Such changes and modifications may be made without departing from the spirit and scope of the invention and without diminishing its attendant advantages. For instance, various components may be repositioned as desired. It is therefore intended that such changes and modifications be included within the scope of the invention. Moreover, not all of the features, aspects and advantages are necessarily required to practice the present invention. Accordingly, the scope of the present invention is intended to be defined only by the claims that follow.

The invention claimed is:

1. A garment covering the lower body of a human subject, which has a first and a second opening configured for legs of the human subject, wherein a pocket comprising at least one pocket opening is positioned between the first and second openings configured for the legs, wherein the pocket is constructed from a stretchable fabric, wherein the pocket comprises a back end, wherein the back end comprises a first pocket opening, wherein the diameter of the first pocket opening is about 1-6 inches when not under tension and/or not being stretched, wherein the pocket is configured to removably hold a chamois, and wherein the chamois is removable through the first pocket opening.

2. The garment of claim 1, wherein the pocket is positioned in the garment so that when it is worn, the pocket will be configured to be positioned between the legs of the wearer.

3. The garment of claim 1, wherein the pocket is configured to be positioned in the garment so that when it is worn it covers the sit bones (ischial tuberosities) of the wearer.

4. The garment of claim 1, wherein the pocket further comprises a front end, a left side, a right side, a proximal layer and a distal layer.

5. The garment of claim 4, wherein the front end comprises a second pocket opening.

6. The garment of claim 5, wherein the first pocket opening is larger than the second pocket opening.

7. The garment of claim 5, wherein the diameter of the second pocket opening is about 0.5-3 inches when not under tension and/or not being stretched.

8. The garment of claim 7, wherein the diameter of the second pocket opening is about 1 inch when not under tension and/or not being stretched.

9. The garment of claim 4, wherein the proximal layer of the pocket is configured to touch the skin of the wearer.

10. The garment of claim 4, wherein the distal layer of the pocket is attached to the proximal layer of the pocket at its perimeter.

11. The garment of claim 4, wherein the distal layer of the pocket is attached to the proximal layer of the pocket by joining the perimeters of the left and right sides.

12. The garment of claim 4, wherein the pocket has a wider profile toward its back end and a narrower profile toward its front end.

13. The garment of claim 4, wherein the pocket comprises a back half, and wherein the average distance between the left and right sides of the pocket in the back half of the pocket is about 1.0-7.0 inches when the pocket is not under tension and/or not being stretched.

14. The garment of claim 4, and wherein the average distance between the left and right sides of the pocket in the front half of the pocket is about 0.5-4.0 inches when the pocket is not under tension and/or not being stretched.

15. The garment of claim 1, wherein the pocket further comprises additional fasteners that reduce the size of the first opening or that close the first opening completely.

16. The garment of claim 1, further comprising a chamois in the pocket.

17. The garment of claim 1, wherein the garment is selected from shorts, pants, tights, bike shorts, bike pants, triathlon shorts, a triathlon suit, bib shorts, bib tights, and hiking shorts.

18. The garment of claim 1, wherein the diameter of the first pocket opening is about 3 inches when not under tension and/or not being stretched.

19. The garment of claim 1, wherein the chamois is about 3-20 mm thick.

* * * * *